United States Patent [19]

Hedgepeth et al.

[11] 4,334,391

[45] Jun. 15, 1982

[54] REDUNDANT DEPLOYABLE LATTICE COLUMN

[75] Inventors: John M. Hedgepeth; Ronald L. Samuels; John Stammreich, all of Carpinteria, Calif.

[73] Assignee: Astro Research Corporation, Carpinteria, Calif.

[21] Appl. No.: 142,221

[22] Filed: Apr. 21, 1980

[51] Int. Cl.[3] ..... E04H 12/18

[52] U.S. Cl. ..... 52/108; 52/646

[58] Field of Search ..... 52/646, 108, 645, 109, 52/648, 110, 111, 121, 123, 638; 343/915; 182/69, 141; 242/54 A

[56] References Cited

U.S. PATENT DOCUMENTS

| | | | |
|---|---|---|---|
| Re. 11,975 | 3/1902 | Davis | 52/638 |
| 415,667 | 11/1889 | Edwards | 52/109 |
| 555,799 | 3/1896 | Barnard | 52/645 |
| 1,054,737 | 3/1913 | Woodbury | 52/638 |
| 3,486,279 | 12/1969 | Webb | 52/108 |
| 3,751,863 | 8/1973 | Lyons | 52/645 |

FOREIGN PATENT DOCUMENTS

| | | | |
|---|---|---|---|
| 1145758 | 10/1957 | France | 52/109 |

*Primary Examiner*—John E. Murtagh

*Attorney, Agent, or Firm*—Spensley, Horn, Jubas & Lubitz

[57] ABSTRACT

The disclosed deployable lattice column includes a plurality of longeron elements connected together and reinforced by lateral elements including both diagonal members and battens. The diagonal members are cross-connected between laterally opposed points along the longerons and define a bay of the column by the spacing of their attachment points. Adjacent bays of the column substantially overlap each other. By this overlapping relationship, should one of the diagonal elements fail, the strength of the column is substantially maintained by the adjacent, overlapping diagonal elements. Preferably, the longeron elements are integral, coilable elastic members.

10 Claims, 4 Drawing Figures

REDUNDANT DEPLOYABLE LATTICE COLUMN

BACKGROUND OF THE INVENTION

1. Field of the Invention

The invention relates to a deployable lattice column which incorporates certain overlapping or redundant, lateral elements to increase the structural capabilities of the column and to preserve the structural integrity of the column should one or more of the redundant lateral elements fail.

2. Prior Art

Deployable lattice columns are used in a variety of environments including both space and terrestial applications. In many of these environments, the column can be subjected to physical destruction, for example by impacting micrometeorites or shrapnel.

In a lattice column such as described in U.S. Pat. No. 3,486,279, it is not unusual that the strength of the column will be decreased by about fifty percent upon destruction of a single diagonal member. Various solutions have been proposed to minimize failure of the column in such hazardous environments. For example, it has been proposed to include a multiplicity of parallel lateral elements in the column. However, this significantly complicates and hinders collape of the column to a compact volume, one of the column's essential features, and does not significantly improve the characteristics of the deployed column. Moreover, adjacent parallel elements both can be destroyed simultaneously by impaction with a micrometeorite or shrapnel fragment. Another approach to achieve a deployable lattice column that will survive small particle impaction has been to vary either the cross-sectional dimensions of the various elements of the column or to change the diameter of the column itself. While this will result in a column of increased strength, both initially and after impaction, such a column presents a substantially increased weight and also occupies a significantly increased volume when collapsed both of which are offsetting disadvantages.

It is an object of this invention to provide a deployable lattice column of substantial strength even upon failure or destruction of one or more of its lateral elements. It is another object of this invention to achieve such a column without substantially increasing its weight or overall size, or its collapsed volume. These and other objects of the invention will appear from the following description of a preferred embodiment.

BRIEF SUMMARY OF THE INVENTION

The redundant deployable lattice column of the invention includes a plurality of longeron elements, between which are connected a plurality of lateral elements. The lateral elements include both battens and diagonal member, pairs of the diagonal members being cross-connected to generally laterally opposed points along the longeron elements and thereby defining a bay of the column. The diagonal elements are connected to the longerons such that adjacent bays substantially overlap. The battens are connected between the laterally opposed connection points of the diagonal members and serve to tension the diagonal elements when the column is in a deployed state.

The longeron and lateral elements are constructed and interconnected to be movable between a deployed orientation defining a column of a substantial length and a second, collapsed orientation defining a structure of significantly smaller length. Preferably, adjacent bays overlap each other by one half or one-third of their length. Also, preferably the lateral elements are connected to the longerons in planes offset from one another sufficiently that the various lateral elements do not bear upon one another when the column is in a deployed state.

Because of the overlapping bays, not only can the column be collapsed to approximately the volume it would occupy if the bays did not overlap, but also it significantly preserves the strength of the column should one or more of the diagonal members fail, due for example to impaction by a micrometeorite or shrapnel fragments. Also, the column may be deployed from its collapsed state using a hoist or deployment system not significantly different than that used for prior lattice column construction such as that described in U.S. Pat. No. 3,486,279.

BRIEF DESCRIPTION OF THE DRAWINGS

The invention will be further described in connection with the accompanying drawings, in which.

DETAILED DESCRIPTION

Previous attempts to provide a deployable lattice column of a strength which is substantially preserved in spite of failure of one or more diagonal element have simply doubled, for example, the size of the column's diagonal elements, or increased the overall size of the column. Such solutions have not proven to be satisfactory for various reasons.

One teaching of the present invention is that a column of significantly improved structural characteristics—not only initial strength but residual strength after failure of a diagonal element—can be achieved by overlapping the bays defined by the diagonal elements. Preferably the bays are overlapped by one half or one-third so that each bay lies midway between adjacent bays. Because of these redundant, overlapped lateral elements, the buckling section of the column is significantly reduced and thus the bending strength of the column is increased three to four times without any increase in the overall diameter of the column. There is, however, some increase in the weight of the column as well as in its parts and complexity, of course.

Figure 1:
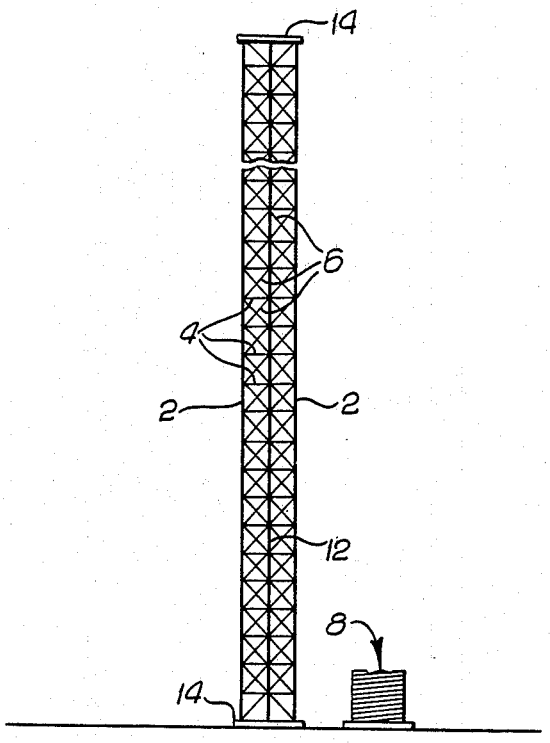
FIG. 1 is an elevational view of the lower portion of a deployed column adjacent to which is a lower portion of a collapsed column.

An example of such a column, employing continuous coilable longeron elements such as described for example in connection with FIG. 7 of U.S. Pat. No. 3,486,279, is shown in FIG. 1. It is of a generally triangular cross-section, and includes three longeron elements 2 between which are connected a plurality of lateral elements including battens 4 and diagonal members 6. Preferably the longeron elements, which may be constructed of a fiberglass laminate, for example, have substantially straight configurations when unbent, but may be coiled into a configuration such as shown in the collapsed column 8 illustrated in FIG. 1 adjacent to the deployed column. Upon being so coiled, the longeron elements exert sufficient strain energy to tend to erect the column as they are released. Such a release may be provided by a lanyard 12 that is attached to the opposed platforms 14, one of which is fixed to each end of the column. When deployed, the battens need not be fully extended, but preferably are somewhat bowed, as shown in FIG. 2, to maintain tension in the diagonal members and thereby the stiffness of the column.

Figure 2:
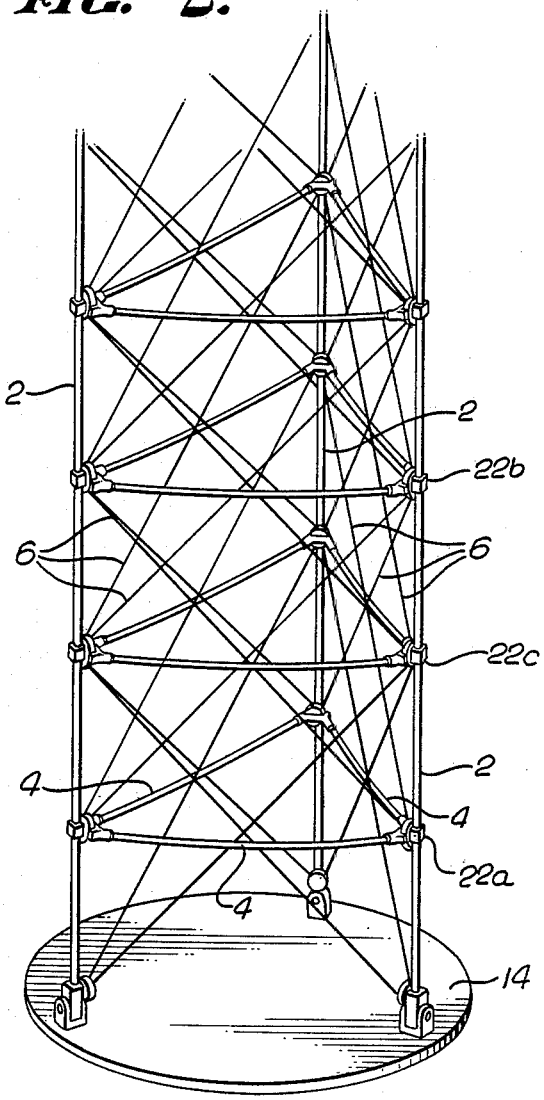
FIG. 2 is a perspective view of the lower portion of a deployed column.

FIG. 2 illustrates in perspective a portion of the deployed column. As it shows, the diagonal members are cross-connected to generally laterally opposed points along the parallel longerons, such connections being provided by corner pivot fittings 22. The lines defined by these diagonal members preferably intersect at the center of the longerons. The paired diagonal members, by their cross-connection to the longeron elements, define a bay of the column. For example, one such bay extends from corner pivot fitting 22*a* to corner pivot fitting 22*b*. In one preferred embodiment, the adjacent bays are connected to the longeron to substantially bisect each bay. Thus, corner pivot fitting 22*c* is approximately half way between pivot fittings 22*a* and 22*b*, and defines one end of the bays which overlap the space between corner pivot fittings 22*a* and 22*b*. In this manner, the buckling section of the longeron, which otherwise would have extended from corner pivot fitting 22*a* to 22*b*, is reduced by one half, thereby increasing the bending strength of the column three to four times. Of course, adjacent bays may overlap by other fractions of their length, such as by one third, if desired.

To achieve a substantial increase in the torsional stiffness of the column, it is important that the battens 4 extending between the laterally opposed corner pivot fittings do not bend or displace the diagonal members of adjacent bays. Should such a displacement occur, a significant decrease in the torsional stiffness of the column will result. One way to prevent such displacement is simply to bend or shape the battens so that they provide clearance for the diagonal members of adjacent columns. However, such bending, if not properly done, can increase the collapsed volume of the column significantly. Another way to avoid such displacement, and the approach preferred by the inventors, is to employ a corner pivot fitting of a unique design such as shown in FIGS. 3 and 4.

Figure 3:
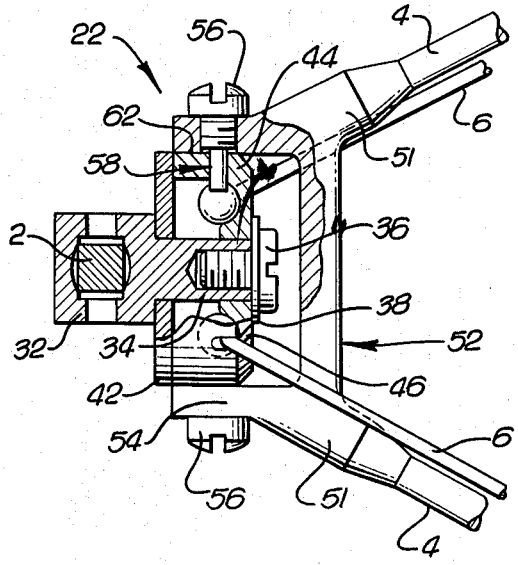
FIG. 3 is a view, partially in horizontal cross-section, of a longeron and a corner pivot fitting.
Figure 4:
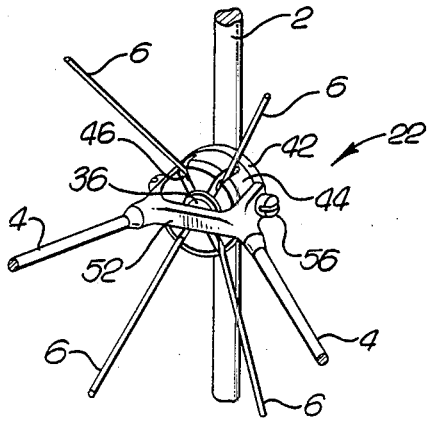
FIG. 4 is a perspective view of a longeron corner pivot fitting.

The corner pivot fitting, shown partially in horizontal section in FIG. 3, consists of pivot fitting 32 which surrounds, and preferably is adhesively bonded to, the longeron 2. Projecting from the pivot fitting is a pivot stud 34 which is internally threaded to receive bolt 36. Bolt 36 holds under its head a washer 38 and onto the stud a backplate 42 and a cup 44. The cup 44 includes keyhole-shaped slots or openings 46 which receive knobs formed at the ends of the diagonals, the knobs and cup thereby attaching the diagonal elements to the corner pivot fitting as shown in FIG. 4.

The batten members 4 are received in, and adhesively secured to, openings formed in projecting bosses 51 on a batten saddle member 52. This member includes projecting arms 54, each of which has an internally threaded opening to receive the threaded shaft of bolt 56. These bolts also include studs 58 which are received in opposed openings 62 in cup 44, thereby attaching the battens to the corner pivot fitting. The bosses 51 are offset such that the planes defined by the battens lie outside the longerons. Since preferably the planes defined by the lateral elements pass through the longerons, this offset of the bosses ensures that the battens do not displace or otherwise interfere with the lateral elements when the column is in a deployed state.

By virtue of the attachment of the battens to the corner pivot fitting, the batten saddle member may rotate relative to cup 44. Also, by virtue of the attachment of the cup to the corner pivot fitting, the cup may rotate about pivot stud 34. This design of the corner pivot fitting permits the battens and diagonal members to rotate and move relative to the longeron as the longeron is being coiled or uncoiled, yet firmly holds the longeron in a given position when the column has been deployed. Also, by this arrangement the batten members can be displaced slightly from the plane defined by the vertically adjacent diagonals, thereby preventing the batten members from interfering with or otherwise displacing the diagonals.

Preferred embodiments of the invention have been described. However, those skilled in this field will appreciate that the principles of incorporated in this invention can be applied to various other deployable lattice columns. Accordingly, the scope of the invention is defined by the following claims.

We claim the right to exclude others from making, using and selling:

1. A deployable lattice column including:

a plurality of continuous longeron elements, a plurality of flexible lateral elements connected between adjacent longeron elements, the lateral elements including flexible diagonal members, pairs of first diagonal members being cross-connected between two pairs of generally laterally opposed points along said longeron elements and defining adjacent bays of the column, second flexible diagonal members being connected to the longerons at least one of said connections being intermediate said laterally opposed points, and the longeron and lateral elements being constructed and connected to constitute a structure movable between a deployed orientation defining a column of substantial length and a second, coil-collapsed orientation defining a structure of smaller length.

2. A column as set forth in claim 1 in which the lateral elements include battens, the battens being connected between said laterally opposed points.

3. A column as set forth in claim 2 in which said first and second diagonal members are of substantially the same length.

4. A column as set forth in claim 3 in which both ends of the second diagonal members are connected intermediate said laterally opposed points.

5. A column as set forth in claim 3 in which there are at least three longeron elements, and in which the battens are connected to the longeron elements to be attached substantially perpendicular thereto when the column is in a deployed configuration.

6. A column as set forth in claim 5 in which the longeron elements are integral, coilable elastic members each of which has a substantially straight configuration when unbent.

7. A column as set forth in claim 3 in which the lateral elements are connected to the longeron elements by corner pivot fittings, the corner pivot fittings including:

a rigid member connected to the longeron and including a laterally projecting pivot, a fitting attached to the pivot to rotate generally in a plane parallel to the longeron, the fitting including attachment means connecting the batten and lateral elements with the longeron.

8. A column such as set forth in claim 7 in which the fitting includes key-hole slots, each lateral member terminating in an enlarged ball received within one of said key-hole slots.

9. A deployable lattice column including three spaced, parallel continuous longeron elements, a plurality of flexible lateral elements connected between the longeron elements, the lateral elements including battens and diagonal members, pairs of first diagonal members being cross-connected to generally laterally opposed points along said longeron elements and defining, with the adjacent cross-connected diagonal members of the third longeron, first set of bays of the column, and pairs of second diagonal members being cross-connected between laterally opposed points along said longeron elements and defining a second set of bays positioned substantially midway between and overlapping the first set of bays, the lateral elements also including battens connected between said laterally opposed points such that, when the column is in a deployed configuration, they do not touch the diagonal members of the overlapping bays, the battens being substantially perpendicular to the longerons when the column is in a deployed configuration, the longerons and lateral elements being constructed and interconnected to constitute a structure movable between a deployed orientation defining a column of substantial length and a second, coil-collapsed orientation defining a structure of a smaller length, the column having a substantially equilateral triangular cross-sectional configuration when deployed.

10. A column such as set forth in claim 9 in which each longeron element is an integral, elastic, coilable self-deploying member which has a substantially straight configuration when unbent, the column including means to control its deployment.

* * * * *